US006699167B2

(12) United States Patent
Manley

(10) Patent No.: US 6,699,167 B2
(45) Date of Patent: Mar. 2, 2004

(54) CUSHIONING CONVERSION MACHINE AND METHOD

(75) Inventor: Thomas E. Manley, Mentor, OH (US)

(73) Assignee: Ranpak Corp., Concord Township, OH (US)

( * ) Notice: Subject to any disclaimer, the term of this patent is extended or adjusted under 35 U.S.C. 154(b) by 88 days.

(21) Appl. No.: 10/080,058

(22) Filed: Feb. 19, 2002

(65) Prior Publication Data

US 2002/0082152 A1 Jun. 27, 2002

Related U.S. Application Data

(63) Continuation of application No. PCT/US01/19632, filed on Jun. 19, 2001.

(60) Provisional application No. 60/212,520, filed on Jun. 19, 2000.

(51) Int. Cl.[7] ..... B31B 1/00

(52) U.S. Cl. ..... 493/464; 493/302; 493/407; 493/478; 493/967

(58) Field of Search ..... 493/464, 967, 493/478, 302, 407

(56) References Cited

U.S. PATENT DOCUMENTS

| | | | | |
|---|---|---|---|---|
| 2,882,802 A | * | 4/1959 | Walker | 493/45 |
| 3,603,216 A | * | 9/1971 | Johnson | 493/359 |
| RE30,031 E | * | 6/1979 | Snellman | 271/222 |
| 4,750,896 A | | 6/1988 | Komaransky et al. | |
| 5,123,889 A | | 6/1992 | Armington et al. | |
| 5,569,146 A | | 10/1996 | Simmons | |
| 5,607,383 A | | 3/1997 | Armington et al. | |
| 5,738,621 A | * | 4/1998 | Simmons | 493/464 |
| 6,200,251 B1 | * | 3/2001 | Harding et al. | 493/464 |

FOREIGN PATENT DOCUMENTS

| | | |
|---|---|---|
| WO | WO 99/34968 | 7/1999 |

* cited by examiner

*Primary Examiner*—Eugene Kim
*Assistant Examiner*—Christopher Harmon
(74) *Attorney, Agent, or Firm*—Renner, Otto Boisselle & Sklar, LLP

(57) ABSTRACT

A cushioning conversion machine having a novel former around which a sheet material is folded to form an improved cushioning product. The former has longitudinally spaced side surfaces inclined from bottom to top toward a downstream end of the machine. The side surfaces cause the obstruction of the sheet stock material upstream of the side surfaces so that the sheet material crumples in the spaces upstream of the side surfaces, thereby increasing the cushioning properties of pillow portions of the cushioning product. The former also has a centrally located base plate which minimizes crumpling in a central portion of the sheet material so that the folded over portions and the central portion can be connected to maintain more effectively the shape of the pillow portions in the resulting cushioning product. In addition, the former has a guard plate mounted above longitudinally spaced bottom edges extending laterally outwardly from the base plate and upstream from a vertical central plane. The former also has a pair of mandrels at its downstream end which internally fluff the crumpled pillow portions before the central portion is connected. The machine also has a width adjustment device for selectively adjusting the width of the resulting cushioning product.

32 Claims, 9 Drawing Sheets

CUSHIONING CONVERSION MACHINE AND METHOD

This application is a continuation of PCT/US01/19632 Jun. 6, 2001which claims benefit of Ser. No. 60/212,520 Jun. 19, 2000.

FIELD OF THE INVENTION

The present invention relates generally to a cushioning conversion machine and method. More particularly, the present invention relates to improved forming assemblies and/or forming steps for cushioning conversion machines and methods.

BACKGROUND OF THE INVENTION

In the process of shipping an item from one location to another, a protective packaging material generally is placed in the shipping case, or box, to fill any voids, to cushion, to block and/or to brace the item during the shipping process. Various types of packing products have been used to pack articles in containers for shipment, including a crumpled paper cushioning product which is biodegradable, recyclable, and composed of a renewable resource, making it an environmentally responsible choice. A particularly desirable crumpled paper product is produced by crumpling one or more plies of sheet stock material, such as kraft paper. The sheet stock material is crumpled and folded upon itself to form a crumpled cushioning dunnage product having lateral pillow portions with a central band therebetween.

The conversion of multi-ply sheet material into a crumpled cushioning product may be accomplished by a cushioning conversion machine, such as those disclosed in U.S. Pat. Nos. 4,750,896; 4,884,999; and/or 5,607,383. (These patents are assigned to the assignee of the present application and their entire disclosures are incorporated by reference.) Each of the cushioning conversion, machines disclosed in the above-identified patents includes a conversion assembly which converts sheet stock material composed of one or more plies into a relatively less dense three-dimensional cushioning product. The conversion assembly includes a forming assembly which forms the sheet stock material into a strip having lateral pillow portions. The conversion assembly also includes a feeding assembly which is positioned downstream of the forming assembly and which pulls the stock material through the forming assembly and connects the strip along a central band.

The forming assemblies in the above-identified patents each comprise an external forming device such as a converging chute and an internal forming device such as a wire frame. The stock material travels through the external forming device and folds around the internal forming device to form the strip of cushioning. This inward folding may result in lateral regions of the stock material experiencing excessive edge tension which sometimes results in ripping or tearing of the stock material, particularly at the lateral edges. In addition, narrower widths of stock material have a tendency to shift laterally within the forming assembly, leading to inconsistently and often improperly formed cushioning products. This also leads to such problems as pads not forming properly from the first portion of a new paper supply, such as a stock roll.

In addition, the resiliency of the pillow portions encourages opening up or separation of the connected portions during manipulation of the dunnage product. The separation of the connected portions is commonly referred to as "unzippering" which generally begins at a longitudinal end of the dunnage product and progresses along the length of the connected portions. This problem also can be caused by the misalignment of the stock material in the forming assembly, as well as by inadequate connection of the overlapped portions of the stock material. This can occur when the overlapped portions have more layers of stock material than are necessary and/or when the overlapped portions include layers of stock material which have been crumpled and have a tendency to separate from adjacent layers.

Over the years, forming assemblies have been modified, improved or otherwise changed. Despite these past modifications, improvements and changes, a need remains for further improvements in cushioning conversion machines and methods with reduced edge tension and/or tearing associated therewith, while at the same time providing sufficient lateral control to form an acceptable cushioning product, and providing sufficient connection to maintain the shape of the cushioning product, with different widths and/or weights of stock material.

SUMMARY OF THE INVENTION

The present invention provides improved forming assemblies and/or forming steps for cushioning conversion machines and methods which address one or more of the aforementioned problems. In general, the present invention provides a cushioning conversion machine having a novel former around which a sheet material is folded to form an improved cushioning product. The former minimizes resistance to the flow of the stock material around the former while providing desirable cushioning properties in the formed cushioning product. The former softens the damming and/or reduces the temporary accumulation of the sheet material that was found to occur in prior art formers and provides for a smoother transition of the flow of crumpled sheet material around the former. The former also encourages the stock material to crumple in lateral regions and minimizes or restricts crumpling in a central region as the strip of cushioning is formed so that the feed assembly can form a better connection between the relatively uncrumpled layers of stock material in a portion of the strip of cushioning to maintain the shape of the formed cushioning product.

According to one aspect of the invention, a cushioning conversion machine for converting sheet stock material into a relatively lower density cushioning product as the sheet stock material moves through the machine from an upstream end toward a downstream end includes a feeding assembly and a forming assembly. The forming assembly includes a former with a top portion having a pair of generally longitudinally extending and coplanar converging lateral top edges. The former also has at least one lateral longitudinally spaced side edge depending from each of the top edges and inclined relative to the plane of the top edges.

According to one embodiment of the invention, the machine further includes support members which form the converging top edges and one or more ribs or rib portions forming the side edges. The support members may support mandrel portions which each have a greater cross-sectional area than the support members and which increase a height dimension and a width dimension of the former in the vicinity of the mandrel portions. In addition or in the alternative, the at least one rib may have a U-shape and/or may include side leg portions and bottom leg portions, the side leg portions forming the at least one inclined side edge. The bottom leg portions may form at least one bottom inclined edge extending from a vertical plane containing a longitudinal axis of the former, laterally outwardly and inclined toward the upstream end of the machine. Additionally or alternatively, the former may include a lateral guard plate mounted above the bottom leg portions. Additionally or alternatively, the former may include a base plate forming a substantially flat central surface extending substantially the length of the former. The base plate may be spaced relative to the chute to minimize crumpling of the central portion of the stock material. The forming assembly may additionally or alternatively include a pad width adjustment device which is selectively adjustable to change the width of the cushioning product by restricting the width or the height of a path of the sheet material.

According to another aspect of the invention, a cushioning conversion machine for converting sheet stock material into a relatively lower density cushioning product as the sheet stock material moves through the machine from an upstream end toward a downstream end includes a feeding assembly and a forming assembly. The forming assembly includes a former with a bottom plate and one or more generally coplanar longitudinally spaced bottom edges extending laterally outwardly from the bottom plate. The bottom edges are inclined relative to a vertical plane containing a longitudinal axis of the former. The bottom edges are inclined laterally outward and toward the upstream end of the machine.

According to yet another aspect of the invention, a method of converting sheet stock material having a central portion, lateral portions and lateral edge portions into a relatively lower density cushioning product, includes feeding the sheet stock material through a forming assembly, folding the lateral edge portions over the central portion to form an unconnected strip having lateral regions and a central region, causing alternate lateral side regions of the unconnected strip to dam behind inclined edges of a former to crumple the lateral side regions thereof, passing crumpled alternate lateral side regions thereof over the inclined edges; and connecting the central region thereof to form a connected strip.

According to another aspect of the invention, a former for use in a cushioning conversion machine to convert sheet stock material into a relatively lower density cushioning product as the stock material moves through the machine from an upstream end toward a downstream end, includes a top portion having a pair of generally longitudinally extending and coplanar converging lateral top edges. The former also includes one or more lateral longitudinally spaced side edges depending from the top edges and inclined relative to the plane of the top edges.

According to still another aspect of the invention, a cushioning conversion machine for converting sheet stock material into a relatively lower density cushioning product as the sheet stock material moves through the machine from an upstream end toward a downstream end. The machine includes a feeding mechanism for moving the sheet stock material through the machine, and a forming mechanism for forming the sheet stock material into the shape of the cushioning product. The forming mechanism includes a pair of generally longitudinally extending and coplanar converging lateral top edges, and one or more lateral longitudinally spaced side edges depending from the top edges and inclined relative to the plane of the top edges.

The foregoing and other features of the invention are hereinafter fully described and particularly pointed out in the claims. The following description and annexed drawings set forth in detail a certain illustrative embodiment of the invention, this being indicative, however, of but a few of the various ways in which the principles of the invention may be employed.

DETAILED DESCRIPTION

Figure 1:
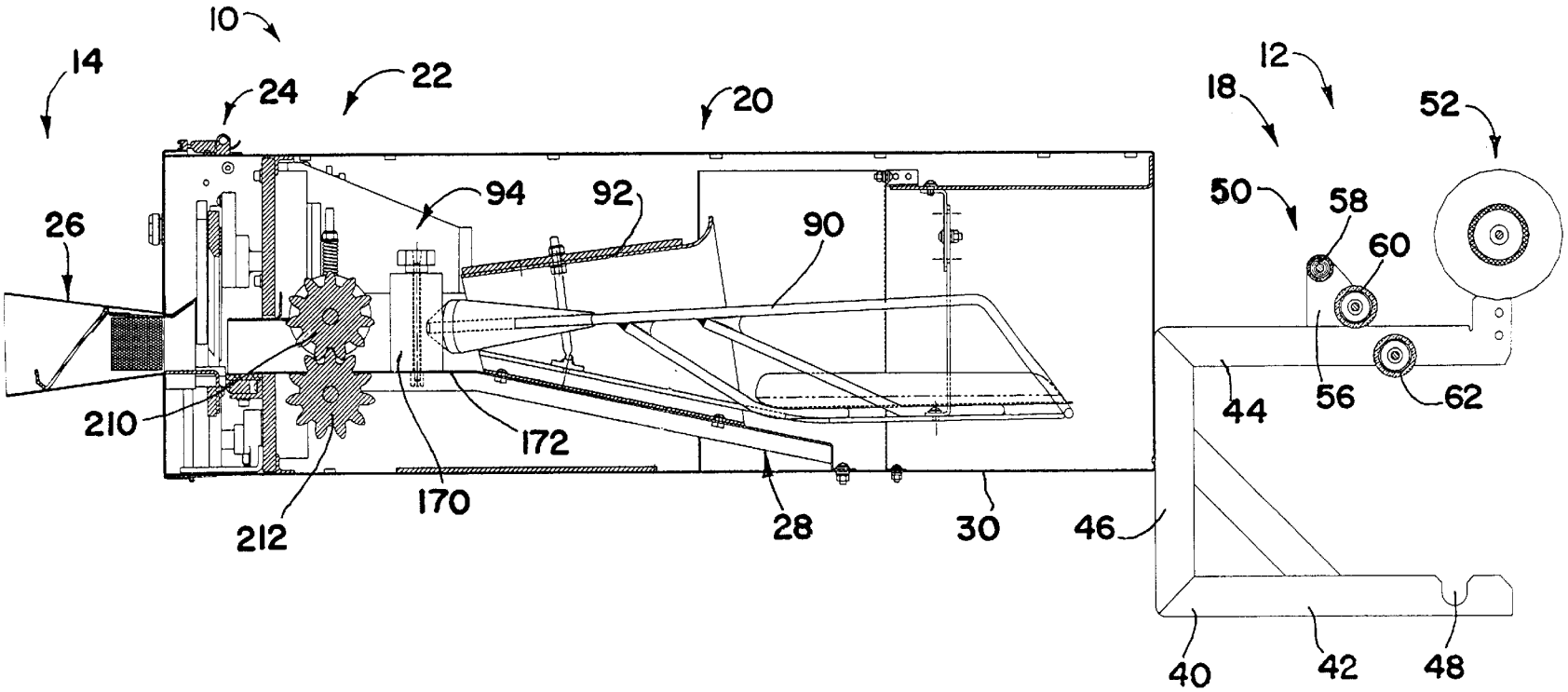
FIG. 1 is a cross-sectional side view of a cushioning conversion machine with a forming assembly according to the present invention.
Figure 2:
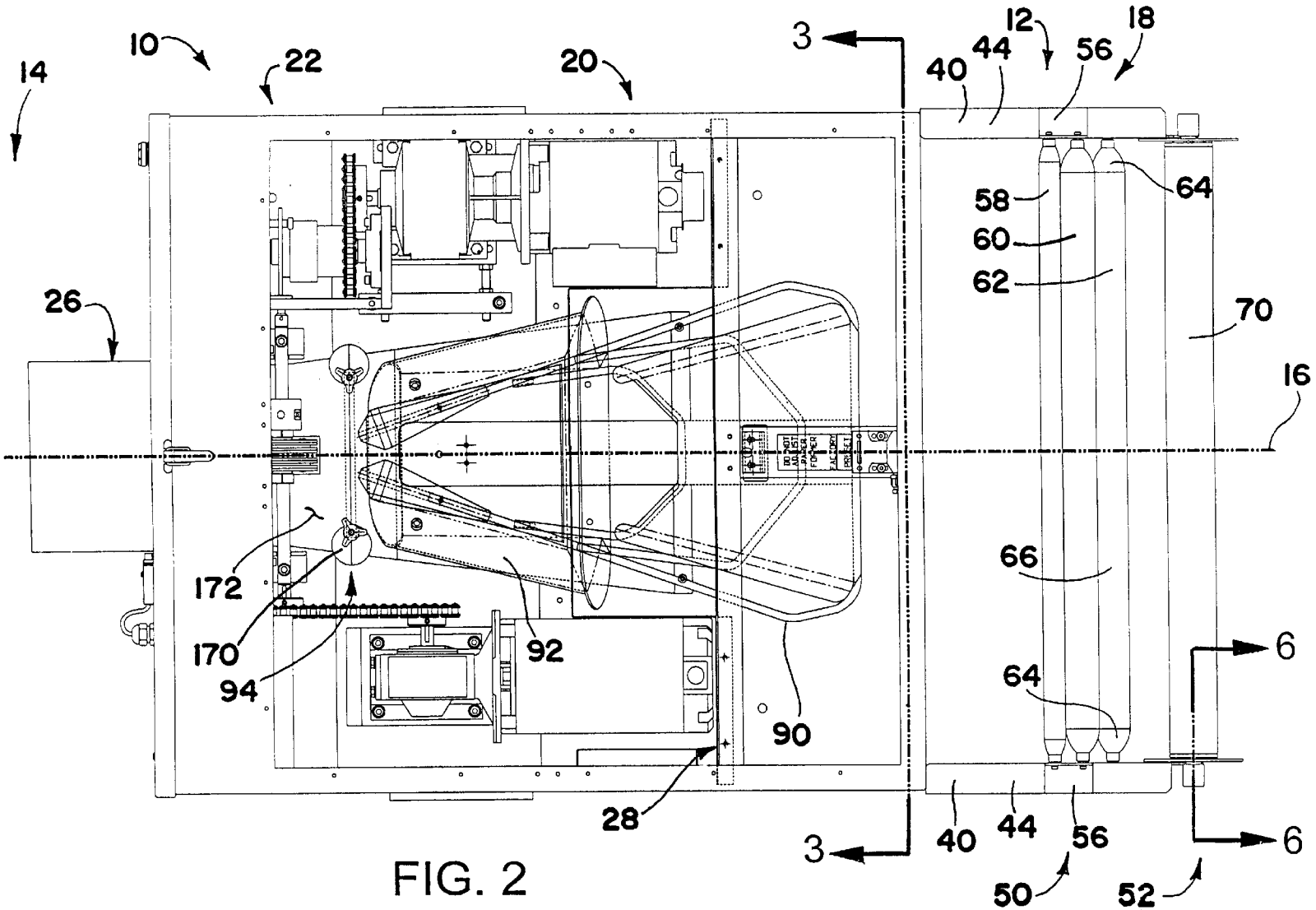
FIG. 2 is a top view of the cushioning conversion machine of FIG. 1 with a top of the housing of the machine removed to show the forming assembly.
Figure 3:
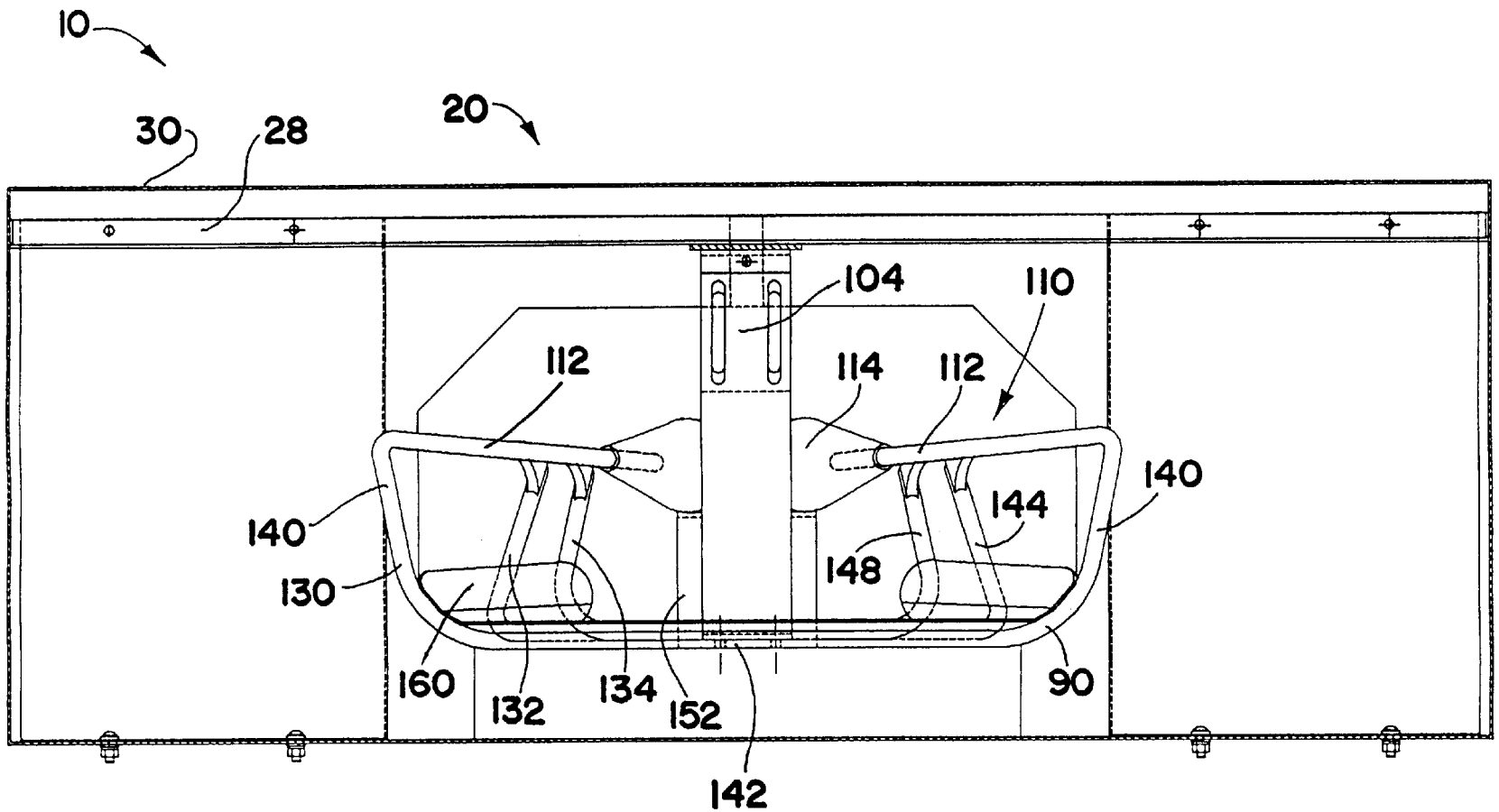
FIG. 3 is a cross-sectional end view of the cushioning conversion machine as seen along line 3—3 of FIG. 2.

A cushioning conversion machine 10 in accordance with the present invention is shown in FIGS. 1–3. The machine has an upstream or "feed" end 12 and a downstream or "discharge" end 14. The machine is positioned in a substantially horizontal manner in the illustrated embodiment whereby a longitudinal line or axis 16 (FIG. 2) from the upstream end to the downstream end is substantially horizontal.

Figure 8:
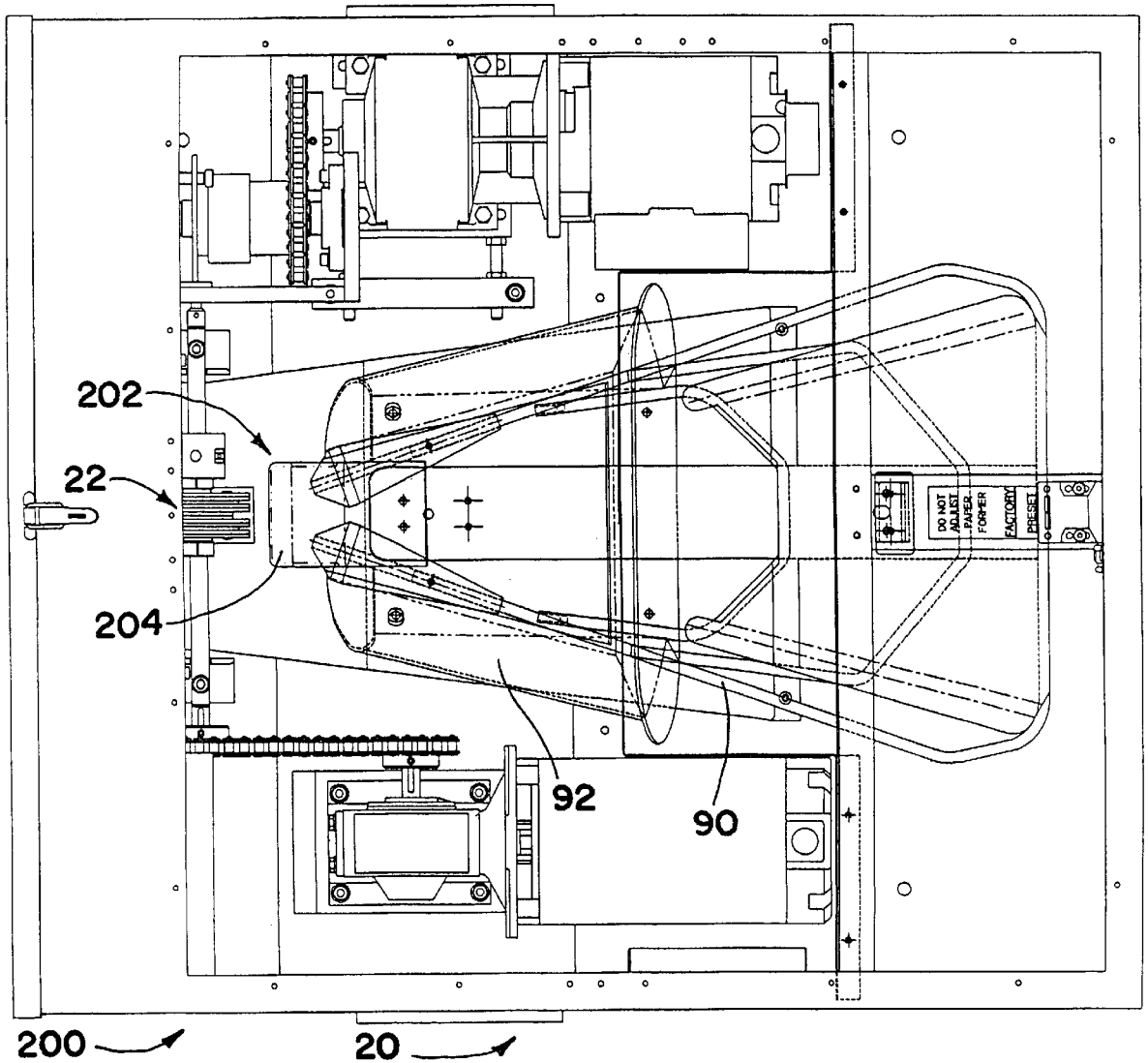
FIG. 8 is a top view of the cushioning conversion machine of FIG. 7 with a top of the housing of the machine removed to show the alternative forming assembly.
Figure 9:
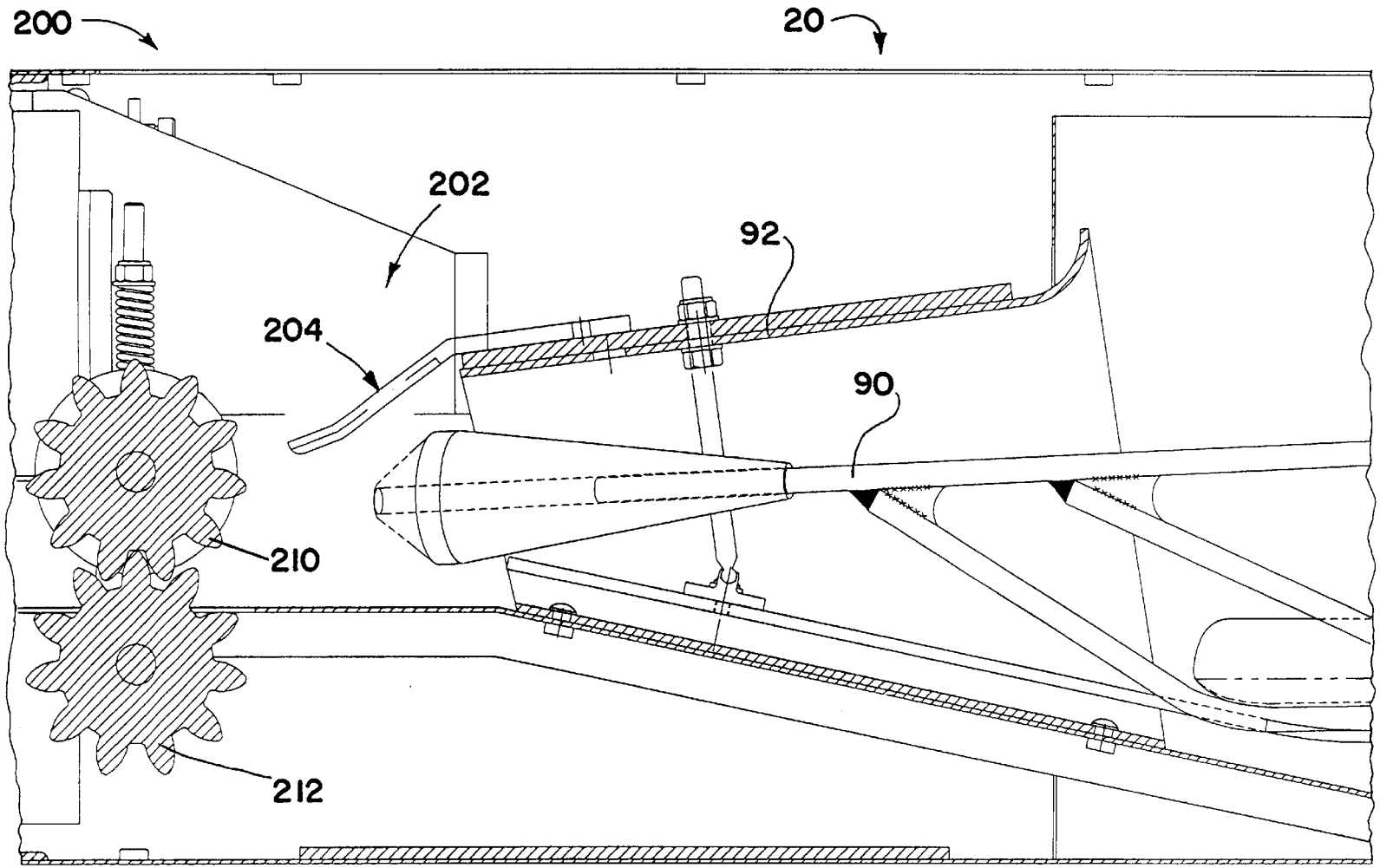
FIG. 9 is an enlarged view of a portion of the forming assembly shown in FIG. 7.

In the following paragraphs (and in the context of the present invention), the downstream direction and/or the longitudinal dimension corresponds to the flow of stock material through the cushioning conversion machine 10 from the upstream end 12 toward the downstream end 14 (the upstream direction being opposite the downstream direction). The transverse dimensions correspond to central vertical and horizontal planes passing through the longitudinal axis of the cushioning conversion machine when the longitudinal axis is horizontally oriented. More specifically, the lateral transverse dimension refers to the horizontal plane or "width" of the cushioning conversion machine (top-to-bottom in FIGS. 2, 5 and 8) and the non-lateral transverse dimension refers to the vertical plane or "height" of the cushioning conversion machine (top-to-bottom in FIGS. 1, 3, 4, 6, 7 and 9). Certain directional modifiers may be used, such as upper, lower, upwardly, top, bottom, etc. These terms correspond to the illustrated orientation, however, the directional modifiers are used solely for convenience, they are not intended to limit the invention to a particular orientation of the cushioning conversion machine.

The machine 10 generally includes a stock supply assembly 18, a forming assembly 20, a feed assembly 22, a severing assembly 24, and a post-severing assembly 26 (one or more of which may be referred to generally as "conversion assemblies"). The machine also includes a frame 28 which supports one or more of the assemblies in the machine, and/or a housing 30 which encloses one or more of the assemblies as well as some or all of the frame.

In operation, the stock supply assembly 18 supplies multi-ply sheet stock material (not shown) to the forming assembly 20. The sheet stock material generally is multi-ply sheet material, for example, a three-ply sheet material such as kraft paper, and is referred to as paper in the following paragraphs, although other forms of single or multi-ply sheet stock material may be used. The forming assembly causes inward folding and crumpling of lateral portions of the paper over a relatively uncrumpled central portion of the paper to form lateral pillow portions of a continuous unconnected strip. The feed assembly 22 pulls the paper from a stock roll (not shown), through the stock supply assembly, and through the forming assembly, and also connects or stitches the central band of the strip to form a connected strip of cushioning. As the connected strip travels further downstream from the feed assembly, the severing assembly 24 severs cushioning products from the strip into sections or pads of desired length. These sections travel through the post-severing assembly 26 for use as dunnage products.

Turning to a more detailed description of the various assemblies, the stock supply assembly 18 supplies the paper, such as the noted three-ply kraft paper, and provides a gradual transition between the supply of the paper, such as from the stock roll, to the forming assembly 20 and the inward turning of lateral edges thereby. Such an arrangement is believed to reduce edge tension in the paper and/or otherwise to enhance the conversion process.

The illustrated stock supply assembly 18 includes two laterally spaced brackets, each generally having a sideways "U" shape with two walls 42, 44 extending perpendicularly outwardly from a connecting wall 46 attached to the machine 10. The lower walls 42 have open slots in their distal ends to cradle a supply rod (not shown) rotatably supporting the stock roll. As the paper is pulled through the machine by the feed assembly 22, the supply rod and/or a hollow tube of the stock roll will freely rotate to dispense the paper from the stock roll. The upper walls 44 of the U-shape brackets support a paper ply separating device 50 and a constant-entry device 52.

The paper separating device 50 separates the plies of paper prior to their passing to the forming assembly 20. The separating device includes a pair of laterally aligned mounting brackets 56 and a plurality of separating members. The number of separating members, namely three—an upper member 58, an intermediate member 60, and a lower member 62—generally corresponds to the number of plies or webs of paper being utilized. The separating members are sized to axially extend the entire transverse dimension (i.e., width) of the paper. In the separating device, the separating members are horizontally and vertically spaced separating bars which extend in a linear transverse path in a direction substantially perpendicular to the path of the paper. The separating members are spaced along a line inclined relative to the vertical with the upper member 58 being located further downstream than the lower member 62. This inclined orientation of the separating members is believed to reduce edge tension in the paper and/or otherwise to enhance the conversion process.

The separating members 58, 60, 62 have a circular cross-sectional shape, which may not have the same diameter along its entire axial dimension. The separating members include end portions 64 and a central portion 66 extending between the end portions. The central portion 66 of the separating member occupies a majority of the member's axial length, and the end portions 64 are inwardly tapered relative to the central portion towards respective ends of the member. The inwardly tapered lateral end portions 64 are positioned to engage the outer ends of the lateral portions of a ply of paper. In this manner, lateral portions of the plies of paper are free to move inwardly in the same direction as the forming assembly 20 inwardly turns the lateral edges of the paper. This allows a gradual, rather than an abrupt, transition between the separating device 50 and the forming assembly 20 thereby reducing the chance of excessive edge-tension and/or otherwise enhancing the conversion process. In the illustrated embodiment, the upper separating member 58 has a smaller diameter than the lower 62 and intermediate 60 separating members since tearing of lateral edge portions of the paper is less common on the upper (inner) ply of the paper than the lower (intermediate and outer) plies and thus less relief is required to eliminate tearing.

The supply assembly brackets 40 also cooperate to support the constant-entry device 52 which is rotatably mounted on the distal ends of the upper bracket walls 44. The constant-entry device provides a non-varying point of entry for the paper from the stock roll into the separating device 50 and forming assembly 20 independent of the diameter of the stock roll. Thus when a different diameter roll is used and/or as the stock roll dispenses paper and decreases in diameter, the point of entry of the paper into the separating device remains constant. This consistency is believed to facilitate the production of a uniform cushioning product.

Figure 6:
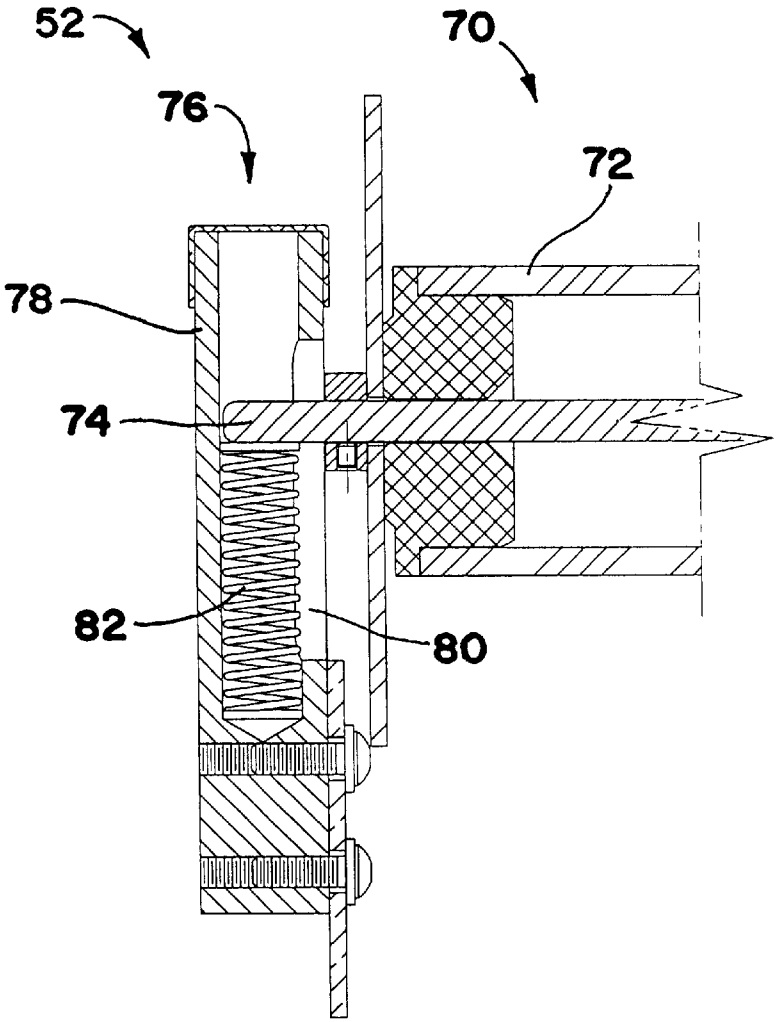
FIG. 6 is a partial cross-sectional end view of a portion of a constant entry roller on the machine as seen along line 6—6 of FIG. 2.
Figure 7:
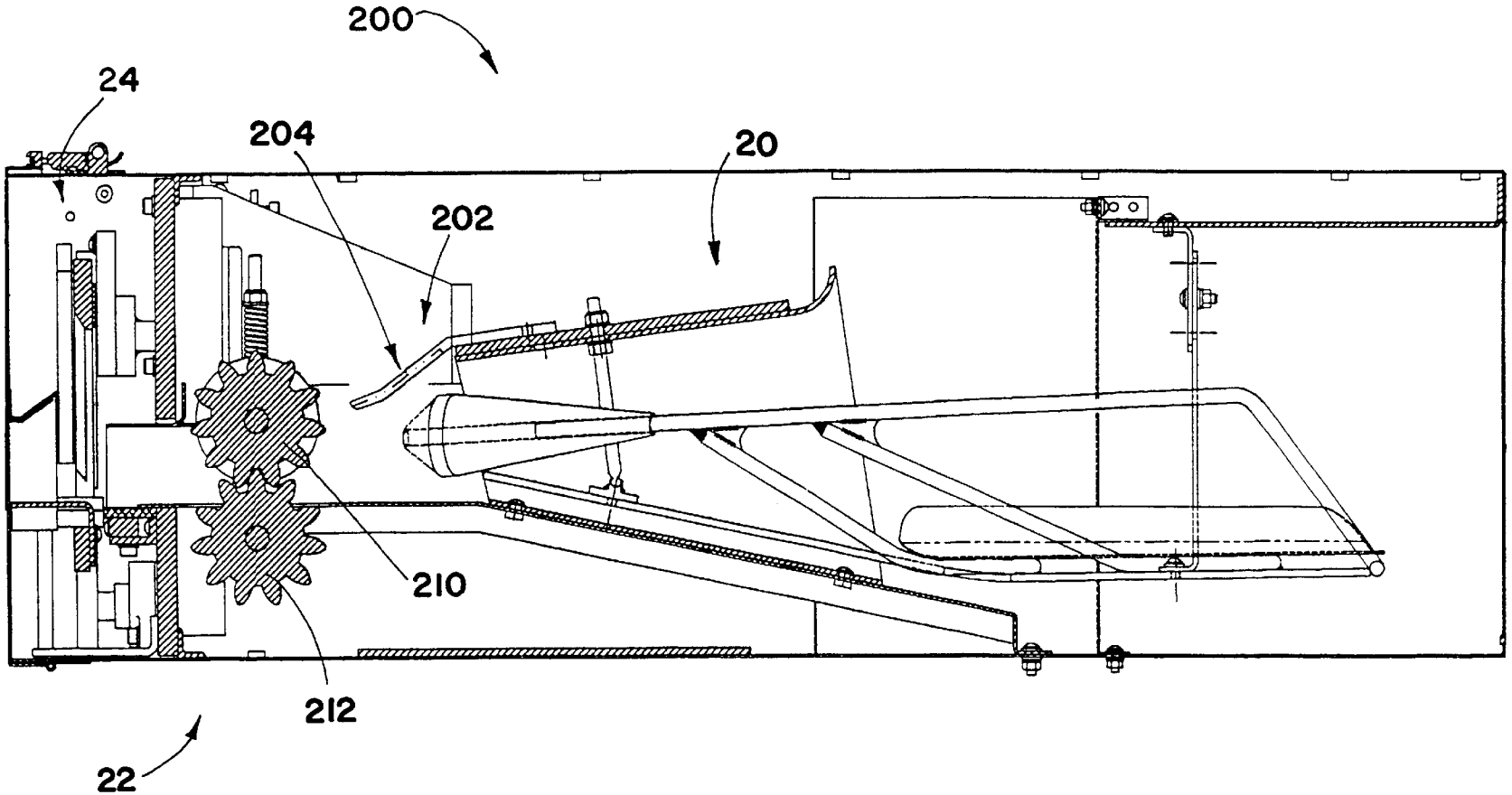
FIG. 7 is a partial cross-sectional side view of a cushioning conversion machine with an alternative forming assembly according to the present invention.

As the paper is drawn into the forming assembly 20 from the stock roll it exerts a downward force on a constant-entry roller 70 of the constant-entry device 52 by reason of the pulling force needed to rotate the stock roll. The illustrated constant-entry device 52 additionally functions temporarily as a force dampening device during a high tension situation, such as during start up. As shown in FIG. 6, the constant-entry device includes the constant-entry roller 70 which has a sleeve 72 and a rod 74 whose ends are resiliently supported and guided by spring-loaded mechanisms 76.

Each spring-loaded mechanism 76 includes a tubular housing 78, an elongated guide slot 80, and a spring 82. The spring 82 resiliently supports the end of the constant-entry roller's rod 74. During start up, when the stock roll must be accelerated from a rest condition to a rotational speed dictated by the feed rate of the feed assembly 22 (FIG. 1), the springs yield and release excessive tension that may cause tearing in the paper. Once the high-tension situation has been resolved and the downward force on the constant-entry roller 70 is normalized the springs bias the rod to its upper position within the slots. For further information about these and other types of separating devices and/or constant-entry devices, U.S. application Ser. No. 09/229,459 filed on Jan. 12, 1999 is hereby incorporated by reference in its entirety. This application is commonly owned by the assignee of the present invention.

Returning to FIGS. 1–6, after the paper is pulled from the stock roll over the constant-entry roller 70 and through the separating device 50, it is pulled through the forming assembly 20. The forming assembly includes an internal forming device, such as a three-dimensional shaping member or former 90, an external forming device, such as a converging chute 92, and a pad width adjustment device 94. The chute and the former are positioned within a common envelope defined by the machine's housing 30. The paper travels between the former and a lower portion of the housing of the machine 10 and then into the chute. During the downstream travel of the paper, the forming assembly causes lateral regions of the paper to crumple and to fold inwardly to form a strip of cushioning having lateral pillow portions. As the strip emerges from the chute, the strip is guided into the feed assembly 22 which connects the layers of paper in a central region of the strip to maintain the shape of the resulting cushioning product.

Figure 4:
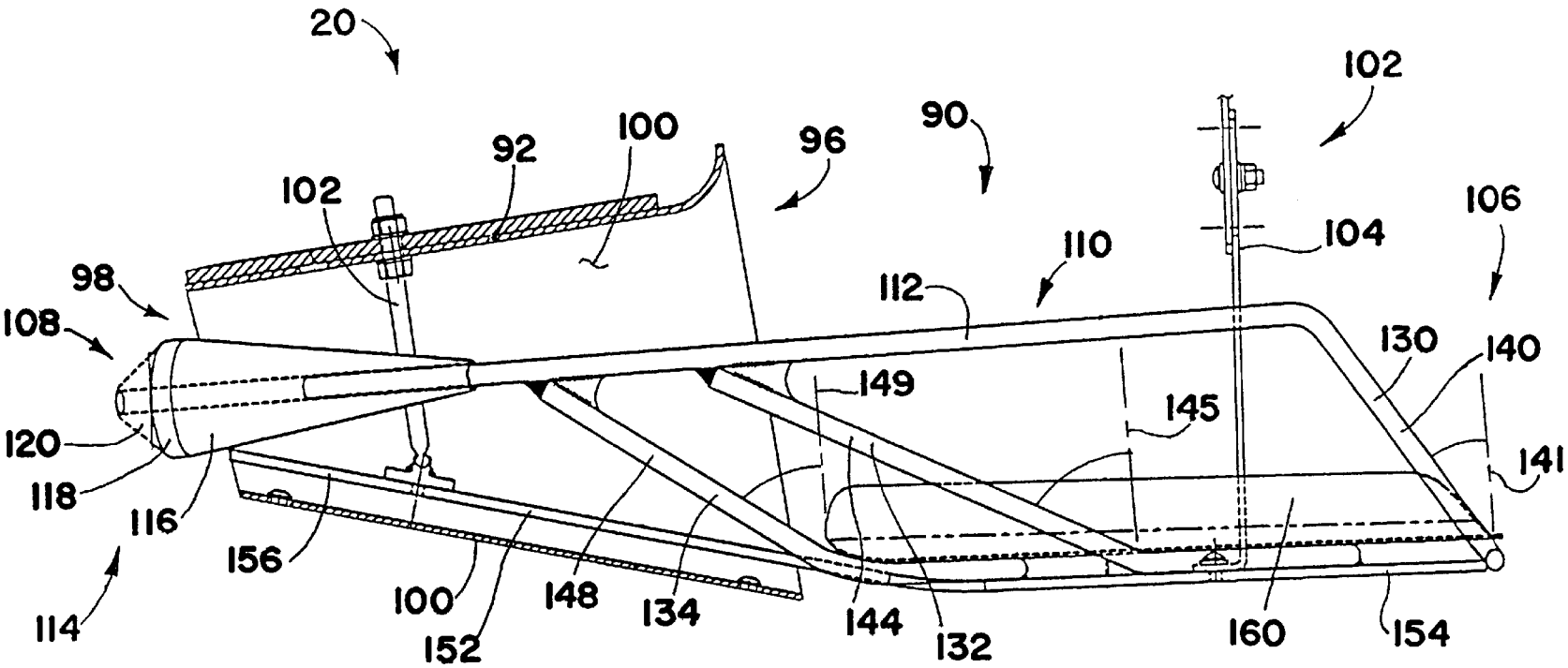
FIG. 4 is an enlarged cross-sectional side view of the forming assembly shown in FIG. 1.
Figure 5:
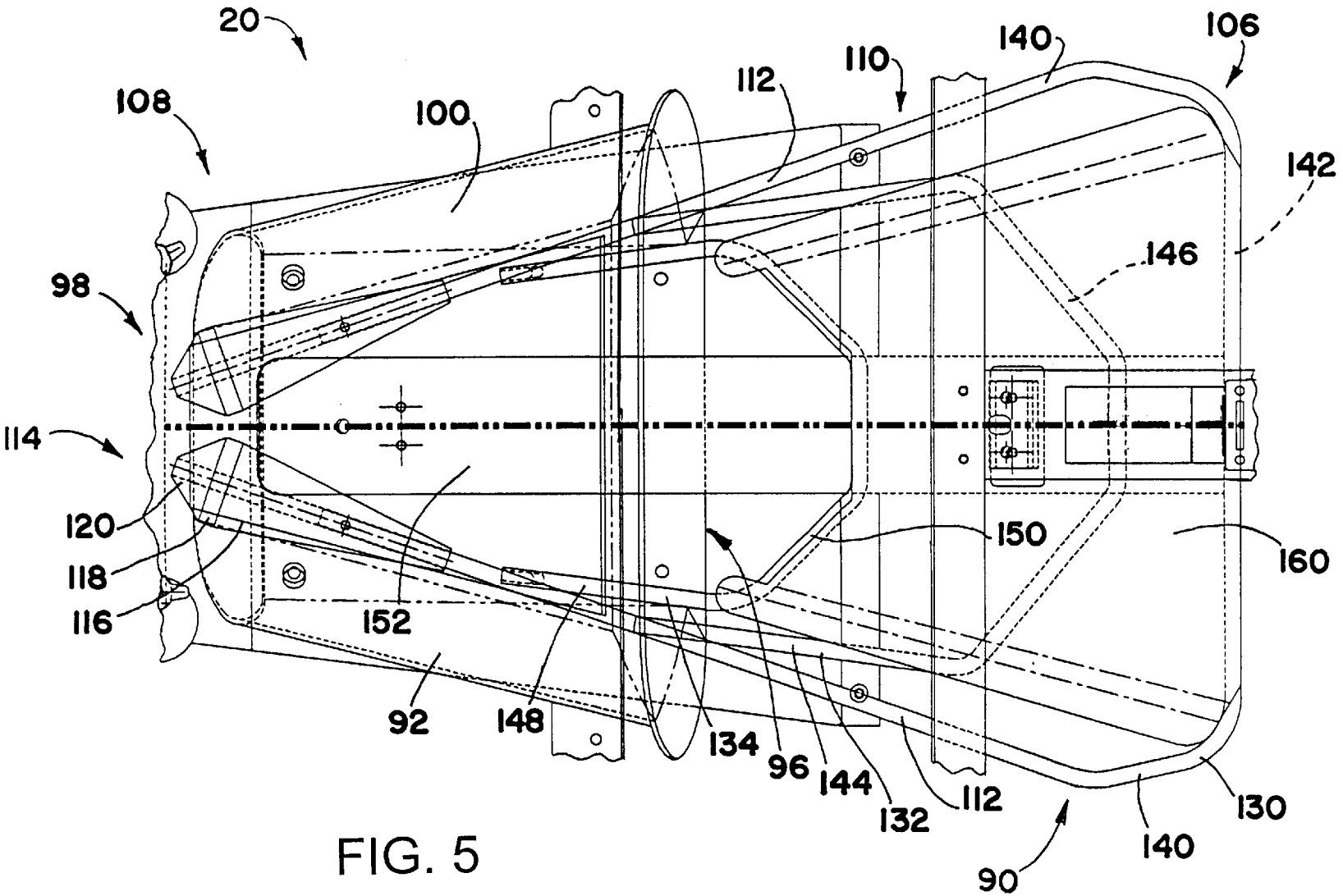
FIG. 5 is an enlarged top view of the forming assembly shown in FIG. 2.

As best seen in FIGS. 3–5, the converging chute 92 has an upstream inlet 96, a downstream outlet 98, and substantially continuous surfaces 100 (i.e., walls) therebetween which converge from the inlet toward the outlet and define a turning space. The former 90 includes one or more mounting brackets 102 for mounting the former to the machine's housing 30, frame 28 and/or the chute such that the former extends into the converging chute. One bracket may be a suspension strap 104 cantilevered from an upstream section of the machine's housing to an upstream portion of the former. The suspension strap is adjustable to selectively position the former at a desired angle relative to the chute.

The former 90 has a generally converging shape along a longitudinal dimension from an upstream end 106 toward a downstream end 108, with converging top surfaces or edges formed by an upper or top portion 110. The converging edges in the illustrated embodiment are formed by a pair of coplanar converging leg portions 112, generally constructed of a bar material, such as metal rod. The converging leg portions give the top a generally V-shape when viewed from above, or more particularly a shape like a "V" with a cut-off vertex and the wider end oriented toward the upstream end 12 of the machine 10.

The former 90 further includes mandrel portions 114 which are attached to the top portion 110 to encourage and/or to induce lateral edges of the paper to curl inwardly as the paper moves over the former. More specifically, the converging leg portions 112 support the mandrel portions which have a greater cross-sectional area than the converging leg portions. The mandrel portions project beyond the coplanar converging leg portions of the top in both the lateral and non-lateral transverse directions. Thus, the converging leg portions which support and position the mandrel portions generally adjacent the outlet 98 of the chute 92, are substantially symmetrical relative to the vertical center plane of the former, and generally aligned longitudinally with the inlet 96 and the outlet 98 of the chute.

Each of the mandrel portions 114 has an upstream cone-shape section 116, a cylindrical-shape section 115 and a downstream cone-shape section 120. In the illustrated embodiment, the mandrel portions have a concentric core through which the downstream ends of the converging leg portions 112 extend to allow the mandrel portions to be selectively moved along the converging leg portions, thereby providing longitudinal adjustment of the mandrel portions. However, mandrel portions formed integrally with the supporting portions are possible with, and contemplated by, the present invention.

The former 90 also includes lateral side edges and bottom edges, which in the illustrated embodiment preferably are formed by one or more ribs constructed of a bar material, such as metal rod. The illustrated former includes three ribs: an upstream rib 130, an intermediate rib 132, and a downstream rib 134. The ribs have a generally "U" shape when viewed from the downstream end (see FIG. 3), the outer lateral sides of the "U" forming the lateral side edges and the bottom of the "U" forming the bottom edges. In the illustrated embodiment, the ribs are inclined relative to a perpendicular to the plane of the converging leg portions 112 such that such that a portion of each rib is closer to one of the converging leg portions and further downstream than another portion of the rib, as will be further explained below.

More specifically, the upstream rib 130 has a pair of side leg portions 140 connected together by a bottom leg portion 142. The upper ends of each of the upstream side leg portions are connected, via a rounded corner, to the upstream end of respective converging leg portions 112 of the V-shape top portion 110. The intermediate rib 132 also has a pair of side leg portions 144 connected through bottom leg portions 146. The upper ends of each of the intermediate side leg portions are connected to aligned sections of the converging leg portions of the V-shape top between the upstream 106 and the downstream 108 ends of the former 90, and are longitudinally spaced downstream of the upstream rib. The downstream rib 134 also has a pair of side leg portions 148 connected through bottom leg portions 150. The upper ends of each of the downstream side leg portions are connected to aligned sections of the converging leg portions of the V-shape top and are longitudinally spaced downstream of the intermediate rib. The bottom leg portions of the ribs generally are coplanar, and the downstream rib generally is upstream of the mandrel portions 114.

The side leg portions 140, 144, 148 of each rib 130, 132, 134, respectively, are inclined relative to the plane of the converging leg portions 112 of the top portion 110, and more particularly, the side leg portions depend from the top from a higher downstream end angled toward a lower upstream end. In the illustrated embodiment, when viewed from the side (FIG. 4) the side leg portions 140 of the upstream rib 130 are angled at approximately 36° relative to the vertical 141 while downstream rib 148 is angled at approximately 54° relative to the vertical 149, and intermediate rib 144 is angled at about 60° relative to the vertical 145, although other angles may be used. It has been found that the forward inclination of the ribs facilitates the formation of crumpled portions of the paper as well as the subsequent flow of those crumpled portions over the ribs as the paper moves in the downstream direction. A more desirable crumpling pattern is formed from the adjacent ribs having different inclinations.

The bottom leg portions 146, 150 of the downstream and intermediate ribs 132, 134, respectively, extend at an angle upstream and outward from a vertical center plane toward an upstream end laterally outward and downstream, and terminate at lower ends of the respective side leg portions 144, 148. When viewed from above, such as in FIG. 2, the bottom leg portions form a herringbone pattern with adjoining bottom leg portions of the intermediate and downstream ribs, respectively, forming a "V" shape opening toward the upstream end 106 of the former 90. Although in the illustrated embodiment the ribs 130, 132, 134, and the top 110 preferably are formed from a bar stock that forms a wire-frame, the former could have generally solid surfaces or could otherwise be formed of different materials.

As the former 90 converges toward the downstream end 108, successive ribs 130, 132, 134 decrease sequentially in height and in width whereby the space enclosed by the ribs sequentially decreases in the downstream direction. Because of the inclined features of the ribs, the overall width of each rib decreases, from an upstream portion of the rib adjacent the intersection between the bottom leg portions 142, 146, 150 and the respective side leg portions 140, 144, 148, toward a downstream portion adjacent the intersection of the side leg portions and the converging leg portions 112 of the top 110. The angled and converging features of the edges formed by the ribs and the top reduce the damming of the paper that occurs relative to the damming in prior art devices, while still providing desirable crumpling, and easing the transition of the crumpled paper past alternate lateral sides of the ribs, thereby also minimizing sudden changes in the tension in the paper that may lead to tearing.

The former 90 further includes a longitudinally extending base plate 152 which has a rectangular strip shape. The base plate extends from the upstream rib 130, under and past the intermediate rib 132, under and past the downstream rib 134 toward the downstream end 108 of the former. More particularly, the upstream end 106 of the base plate is attached (e.g., welded) to a laterally central section of the bottom leg portion 142 of the upstream rib and one or more intermediate portions of the base plate is attached (e.g., welded) to the bottom leg portions 146, 150 of the intermediate and/or downstream ribs 132, 134, respectively. The downstream end of the base plate extends freely beyond the downstream rib.

The illustrated base plate 152 has a substantially flat surface separated into upstream and downstream sections 154, 156, respectively, which are angled relative to each other. In the illustrated embodiment, the angle between the two sections of the base plate is approximately six degrees. As a result, when the former 90 is mounted in the machine 10, the downstream and upstream sections 154, 156, respectively, of the base plate lie near and substantially parallel to a bottom surface of the chute 92 and a bottom surface of the housing 30 of the machine 10, respectively. The bottom surface of the base plate defines a holding surface which holds the central portion of the paper at a predetermined distance from the chute's bottom wall as the lateral portions of the paper turn inwardly and crumple. This distance is different than and generally less than the distance that the central portions of the paper would travel in the absence of the base plate and minimizes crumpling in the central portion of the paper. By minimizing crumpling of the central portion of the paper, the base plate facilitates the formation of a better and more uniform connection by the feed assembly 22 between the layers of paper in the central region of the formed strip.

The illustrated former 90 also includes a guard plate 160 mounted above the bottom leg portions 142, 146, 150 of the ribs 130, 132, 134, respectively. The guard plate extends slightly upward inside the side leg portions 140, 144, 148 of the ribs 130, 132, 134, respectively, laterally outwardly of the base plate 152 and longitudinally from the upstream rib 130 to the downstream rib 134. The guard plate minimizes the extent to which the paper moves into the spaces between the longitudinally spaced ribs. Thus, the guard plate provides relatively shallow crumpling compared to crumpling from relatively unrestricted movement of the paper into the spaces between prior art ribs, thereby further minimizing the opportunity for the paper to catch between the bottom rib portions and the base plate and/or to create a sudden increase in tension as the crumpled paper passes over a rib, either of which may cause tearing or misalignment of the paper.

In operation, as the paper travels through the turning space of the chute 92, the converging surfaces 100 of the chute form an outer boundary and radially restrict the paper while portions of the former 90 define a turning perimeter around which the lateral portions of the paper are inwardly turned. The relatively wide upstream end 106 of the former (the upstream rib 130) helps to support and guide the plies of paper into the chute. The inclined ribs 130, 132, 134 act as stabilizers to reduce misalignment of the paper in the forming assembly 20. The inclined ribs also perform as temporary dams upstream of which the paper crumples on alternate lateral sides of the former before progressing past the ribs. Folds and creases form in the paper generally parallel to each rib as the paper crumples in the space upstream of each rib, and the memory of the paper maintains the general shape of these creases and folds that make up the crumpled portions or regions as the paper moves downstream and over alternate lateral sides of each rib. More particularly, a crumpled region of paper progresses past one lateral side of a rib while a laterally opposite portion of the paper dams and crumples behind the other lateral side of the rib. The process continues in this fashion on alternate sides of the rib, forming a herringbone pattern of crumpled regions in the stock material which increase the "height" or "fluff" of the lateral pillow portions of the resulting cushioning product. Crumpling is minimized under the base plate 152, while the paper crumples to a greater extent in the vicinity of the guard plate 160 in the central portions of the paper adjacent the base plate, but to a lesser extent than lateral portions of the paper in the vicinity of the lateral side leg portions 140, 144, 148 of the ribs 130, 132, 134, respectively. The inclined nature of the ribs is believed to facilitate the crumpling process as well as to facilitate the crumpled paper's progression downstream over each rib without catching on a rib or suddenly increasing the tension in the paper and causing misalignment or tearing of the paper.

As the paper moves over the former 90, the mandrel portions 114 induce and perpetuate edge curl in the lateral portions of the paper. The mandrel portions also begin to internally shape the strip of paper prior to it emerging from the outlet 98 of the chute 92. During this pre-outlet shaping, the upstream mandrel sections 116 play the dominant shaping role, the mandrel portions being shaped to increase the lateral transverse dimension (i.e., width) and the non-lateral transverse dimension (i.e., height) of the cross-sectional geometry of the strip.

The upstream end 106 of the former 90 supports and directs the outermost edges of the paper and the converging leg portions 112 of the top portion 110 provide support to lateral portions of the paper as it travels to the downstream end 108 of the former where the mandrel portions 114 induce edge curl and internally expand the crumpled pillow portions of the strip. The inclined lateral ribs 130, 132, 134 act as stabilizers to reduce misalignment of the paper and also perform as temporary dams whereby friction between the paper and the ribs leads to the formation of crumpled folds generally parallel to and upstream of each rib. As the paper progresses through the forming assembly 20 and is pulled over alternate lateral sides of each rib the crumpled folds formed upstream of the rib remain substantially crumpled, thereby forming a herringbone pattern of crumpled regions in the strip.

As the formed strip exits the chute 92, it passes through the pad width adjustment device 94. The pad width adjustment device provides for selective adjustment of the cross-sectional geometry of a cushioning pad formed by the machine 10, particularly the width of the strip of cushioning, without the replacement of forming assembly 20 components. The pad width adjustment device shown in FIGS. 1–2 includes a pair of guide members 170 mounted to frame 28 of the machine 10 between the outlet 98 of the converging chute 92 and the feed assembly 22. Thus, the device may be viewed as forming an extension of the converging chute.

The guide members 170 in the illustrated embodiment have a smooth cylindrical shape with an axial dimension approximately equal to the height of the outlet 98 of the chute 92, and are positioned so that their lower axial ends are adjacent to a guide tray 172 which forms part of the frame 28 that supports the chute. The guide members have an axially extending core through which mounting components extend to non-rotatably support the guide members. The cores are eccentrically (i.e. non-centrally) located on each of the guide members to allow selective adjustment of the spacing or distance between the cylindrical surfaces of the guide members.

When the guide members 170 are positioned so that the shortest distance between the outer circumference of the guide members is a distance approximately equal to the width of the outlet 98 of the converging chute 92, the guide members will guide the strip emerging from the chute in a non-converging path as it passes therebetween. Thus, the width of the pad will be the same as if the machine 10 did not include the pad width adjustment device 94. When the guide members are positioned so that the shortest distance between the outer circumference of the guide members is decreased to less than the width of the outlet of the converging chute, the guide members guide the strip and compress it into a narrower form thereby resulting in a narrower pad. The guide members may include locking members to lock them in the selected positions. For further information about these and other types of guide members, U.S. application Ser. No. 09/189,551 filed on Nov. 11, 1998 is hereby incorporated by reference in its entirety. This application is commonly owned by the assignee of the present invention.

An alternative embodiment of the pad width adjustment device 94 described above is shown in FIGS. 7–9. In the illustrated embodiment the machine 200 is substantially identical to the machine 10 described with reference to FIGS. 1–6 with common parts being referred to by common reference numbers. The alternative pad width adjustment device 202 lacks the guide members 170 described above and instead includes a deflection bracket or "nose" 204 mounted to an upper portion of the converging chute 92 adjacent the outlet 98. The deflection bracket 204 extends downward and downstream from the top of the chute. Without the lateral restriction of the guide members and with the non-lateral transverse restriction of the deflection bracket, the non-lateral transverse dimension (i.e, height) of a path of the paper downstream of the outlet is reduced such that the deflection bracket deflects an upper surface of the formed strip exiting the chute. In response, the lateral transverse dimension (i.e., width) of the strip increases, thereby providing for the production of a pad with a greater lateral transverse dimension (i.e., a substantially wider pad). Although described within the context of the illustrated machine, either embodiment of the pad width adjustment device also may be used with a prior art machine to adjust the width of the resulting cushioning product.

In either of the above embodiments (FIGS. 1–9), as the strip passes the pad width adjustment device 94 and/or 202, it is guided to the feed assembly 22 which includes rotating feed members 210, 212 between which the paper travels. For example the feed members may include a loosely meshed idler gear 212 and drive gear 210. When the gears are turned in the appropriate direction, the central band of the strip is engaged by the gear teeth and pulled downstream through the nip of the gears. This same "engaging" motion caused by the meshing teeth on the opposed gears simultaneously compresses or "coins" the layers of paper in the central band together thereby mechanically interconnecting the layers of material in the central band and forming the connected strip. The connection may be enhanced by stitching gears which perforate and "stitch" the layers of paper together. For further information about these and other types of feed members, U.S. application Ser. No. 08/607,607 filed on Feb. 27, 1996 is hereby incorporated by reference in its entirety. This application is commonly owned by the assignee of the present invention. Reference also may be had to other applications and/or patents incorporated herein by reference.

Discrete cushioning products or pads of the desired length are then severed from the connected strip by the severing assembly 24. The severing assembly may be of any suitable type, such as the types disclosed in U.S. Pat. No. 5,123,889, U.S. patent application Ser. No. 08/110,349 and/or U.S. Pat. No. 5,569,146. (These patents and this application are commonly owned by the assignee of the present invention and their entire disclosures are hereby incorporated by reference.) However whatever type of severing assembly is used, the connected strip is divided into cut sections or pads of the desired length and these cut sections travel downstream to the post-severing assembly 28. A cut section emerging from the post-severing assembly may be directed to a desired packaging location. The conversion of paper into pads of relatively low density cushioning dunnage is now complete, the conversion process having been improved as described in the above paragraphs.

Although the invention has been shown and described with respect to certain illustrated embodiments, equivalent alterations and modifications will occur to others skilled in the art upon reading and understanding the specification and the annexed drawings. In particular regard to the various functions performed by the above described integers (components, assemblies, devices, compositions, etc.), the terms (including a reference to a "means") used to describe such integers are intended to correspond, unless otherwise indicated, to any integer which performs the specified function (i.e., that is functionally equivalent), even though not structurally equivalent to the disclosed structure which performs the function in the herein illustrated embodiments of the invention. In addition, while a particular feature of the invention may have been described above with respect to only one of several illustrated embodiments, such a feature may be combined with one or more other features of the other embodiment, as maybe desired and advantageous for any given or particular application.

What is claimed is:

1. A cushioning conversion machine for converting sheet stock material into a relatively lower density cushioning product as the sheet stock material moves through the machine from an upstream end toward a downstream end, comprising a forming assembly including a former about which lateral regions of the stock material turn as the stock material moves through the forming assembly, the former including a top portion having a pair of generally longitudinally extending, and coplanar converging lateral and laterally spaced top edges that support the lateral regions of the stock material as the lateral regions turn inwardly around the former and which converge toward each other, and at least one two longitudinally spaced side edge-depending edges that extend obliquely from each of the top edges, and the side edges defining therebetween a space recessed in relation to the side edges wherein the sheet stock material can move to enhance crumpling, thereby facilitating Progression of the sheet stock material past the side edges while inhibiting tearing.

2. A cushioning conversion machine as set forth in claim 1, wherein the side edges are inclined relative to the top edges such that an upper end is farther downstream than a lower end and an upstream side of the side edges form an acute angle with respect to the top edge.

3. A cushioning conversion machine as set forth in claim 1, wherein the forming assembly includes a converging chute into which the former extends.

4. A cushioning conversion machine as set forth in claim 3, wherein the converging chute and the former generally converge toward the downstream end of the machine.

5. A cushioning conversion machine as set forth in claim 1, wherein the former includes at least one laterally extending rib forming the a pair of laterally spaced side edges that extend from respective top edges.

6. A cushioning conversion machine as set forth in claim 5, wherein the top portion includes a pair of laterally spaced coplanar support members arranged on intersecting lines, the support members forming to form the converging top edges.

7. A cushioning conversion machine as set forth in claim 5, wherein the at least two side edges are inclined relative to a perpendicular to the plane of the support members such that a portion of the at least one rib is closer to one of the support members and further downstream than another portion of the at least one rib.

8. A cushioning conversion machine as set forth in claim 5, wherein the former further includes a pair of mandrel portions mounted on the support members so as to expand the lateral regions of the sheet stock material as the lateral regions turn around the former, the mandrel portions having a greater cross-sectional area than the support members, whereby the mandrel portions increase a height dimension and a width dimension of the former in the vicinity of the mandrel portions relative to a section of the former upstream of the mandrel portions.

9. A cushioning conversion machine as set forth in claim 8 wherein the mandrel portions are positioned adjacent a downstream end of the support members.

10. A cushioning conversion machine as set forth in claim 5, wherein the former includes three longitudinally spaced ribs: an upstream rib, an intermediate rib, and a downstream rib.

11. A cushioning conversion machine as set forth in claim 10, wherein the upstream rib and the downstream rib form inclined side edges which are inclined at different angles.

12. A cushioning conversion machine as set forth in claim 10, wherein the upstream and downstream ribs form inclined side edges which are inclined approximately thirty-six and fifty-four degrees, respectively, relative to an upstream side of the side edges and respective top edges.

13. A cushioning conversion machine as set forth in claim 10, wherein the top portion and the upstream rib are formed as a unit.

14. A cushioning conversion machine as set forth in claim 10, wherein the intermediate rib forms at least one inclined side edge with a different inclination than the inclined side edges formed by the upstream and downstream ribs.

15. A cushioning conversion machine as set forth in claim 11, wherein the at least one rib and includes side leg portions and bottom leg portions, the side leg portions forming the at least two inclined side edges.

16. A cushioning conversion machine as set forth in claim 15, wherein the bottom leg portions have at least one bottom edge extending from a vertical plane containing a longitudinal axis of the former, the bottom edge extending from a central downstream section laterally outwardly and inclined in an upstream direction to join respective side edges.

17. A cushioning conversion machine as set forth in claim 15, wherein at least two bottom leg portions are generally V-shaped.

18. A cushioning conversion machine as set forth in claim 15, wherein the former includes a lateral guard plate mounted above the bottom leg portions and below the top edges.

19. A cushioning conversion machine as set forth in claim 18, wherein the lateral guard plate extends substantially across the width of the bottom leg portions of the ribs.

20. A cushioning conversion machine as set forth in claim 18, wherein the lateral guard plate extends substantially between the side leg portions of the ribs.

21. A cushioning conversion machine as set forth in claim 18, wherein the lateral guard plate extends longitudinally between the side leg portions of the ribs.

22. A cushioning conversion machine as set forth in claim 1, wherein the former includes bottom edges that connect respective left and right lateral side edges and a base plate mounted below the bottom edges that presents a bottom side of the former with a substantially flat central surface extending substantially the length of the former.

23. A cushioning conversion machine as set forth in claim 22, wherein the base plate is spaced relative to the chute to minimize crumpling of the central portion of the stock material.

24. A cushioning conversion machine as set forth in claim 22, wherein the base plate has two planar sections inclined relative to each other.

25. A cushioning conversion machine as set forth in claim 3, wherein the forming assembly includes a pad width adjustment device downstream of the chute so as to adjust the width of a strip of cushioning downstream of the former before the shape of the cushioning product is fixed.

26. A cushioning conversion machine as set forth in claim 25, wherein the pad width adjustment device is selectively adjustable to change the width of the cushioning product.

27. A cushioning conversion machine as set forth in claim 25, wherein the pad width adjustment device includes a pair of laterally spaced apart cylinders adjustably mounted on eccentric axes extending substantially perpendicular to a path of the sheet material moving through the machine.

28. A cushioning conversion machine as set forth in claim 25, wherein the pad width adjustment device restricts a path of the stock material to reduce the thickness and increase the width of the cushioning product.

29. A cushioning conversion machine as set forth in claim 1, wherein the forming assembly forms an unconnected strip of cushioning and a feed assembly downstream of the forming assembly connects a central region of the strip to form a connected strip.

30. A cushioning conversion machine as set forth in claim 29, wherein the feed assembly includes a pair of gears.

31. A cushioning conversion machine as set forth in claim 28, further comprising a severing assembly for severing the connected strip to form discrete cushioning products.

32. A cushioning conversion machine for converting sheet stock material into a relatively lower density cushioning product as the sheet stock material moves through the machine from an upstream end toward a downstream end, comprising a feeding mechanism for moving the sheet stock material through the machine, and a forming mechanism upstream of the feeding mechanism for forming the sheet stock material into the shape of the cushioning product, the forming mechanism including a chute that converges toward a longitudinal axis of the forming mechanism in a downstream direction and a former extending into the chute that has a pair of generally longitudinally extending, laterally spaced apart and coplanar top edges that converge toward each other and support lateral regions of the stock material as the lateral regions turn inwardly around the former, and two or more lateral longitudinally spaced side edges depending from the top edges whereby the side edges act as dams upstream of which the sheet stock material crumples in spaces between the side edges so as to form folds in the sheet stock material generally parallel to the side edges, the side edges also being inclined relative to the plane of the top edges so as to form an acute angle with the top edges on an upstream side of the side edges thereby facilitating progression of the sheet stock material past the side edges while inhibiting tearing.

* * * * *